US005160083A

United States Patent [19]

Lafreniere

[11] Patent Number: 5,160,083

[45] Date of Patent: Nov. 3, 1992

[54] WINDOWED FOLDING CARTONS

[75] Inventor: Loren F. Lafreniere, Matthews, N.C.

[73] Assignee: Rexham Corporation

[21] Appl. No.: 778,382

[22] Filed: Oct. 16, 1991

[51] Int. Cl.[5] ..... B65D 5/42

[52] U.S. Cl. ..... 229/162; 206/45.31

[58] Field of Search ..... 229/162, DIG. 10; 206/45.31, 45.34

[56] References Cited

U.S. PATENT DOCUMENTS

| | | | |
|---|---|---|---|
| 3,178,086 | 4/1965 | Palmer | 229/162 |
| 4,664,648 | 5/1987 | Dupuy | 206/45.31 |
| 4,733,916 | 3/1988 | Seufert | 206/45.31 |
| 4,964,563 | 10/1990 | Chaygneaud-Dupuy | 229/162 |

FOREIGN PATENT DOCUMENTS

| | | | |
|---|---|---|---|
| 3937991 | 5/1990 | Fed. Rep. of Germany | 229/162 |
| 1361598 | 4/1964 | France | 206/45.31 |
| 2599335 | 12/1987 | France | 229/162 |
| 2220643 | 1/1990 | United Kingdom | 229/162 |

*Primary Examiner*—Gary E. Elkins

*Attorney, Agent, or Firm*—Schweitzer Cornman & Gross

[57] ABSTRACT

A windowed paperboard carton having a window aperture extending across two or three major wall panels, which aperture is closed by a clear plastic sheet. The plastic is adhered to the carton in selected areas but not in zones of articulation where the window goes around the corner of the carton. Special elongated slots are disposed along the lines of articulation of the plastic sheet and paperboard in non-adhesive areas to eliminate deleterious stress concentrations in the composite paperboard-plastic sheet blank.

4 Claims, 3 Drawing Sheets

WINDOWED FOLDING CARTONS

BACKGROUND OF THE INVENTION

The present invention relates to the art of folding paperboard cartons in general and to windowed folding cartons in particular. The windows extend into two or more contiguous walls of the carton and they are covered by transparent thermoplastic sheets. Cartons of this general type are well known to the art and are disclosed, for example, in U.S. Pat. Nos. 4,826,004; 4,846,775; and 4,733,916. It is to improvements in this type of windowed folding carton having an "around-the-corner" window that the present invention is directed.

When the flat paperboard blanks from which folding cartons are die cut are formed with large apertures which serve as viewing windows in the finished cartons, those windows extend over to contiguous panels of the blank (eventually walls of an erected carton) and the windows are typically closed off and sealed completely about their peripheries with sheets of transparent plastic sheet. The bonding of the clear plastic sheet to the paperboard about the edges of the window aperture is effected by means of an adhesive which is typically applied in a circumscribing pattern about the window aperture. While cartons erected from this type of windowed blank are very attractive and desirable for the purposes of providing large display areas of packaged goods, the folding and bending of the comparatively stiff plastic sheet along with the underlying paperboard panels often creates tension as well as compression stresses in the joined materials which often results in the tearing of the paperboard along the fold lines at the overlap of the plastic sheet with the paperboard or forms wrinkles in the overlying plastic sheet near the edges of the aperture forming the borders of the window at the area of the fold line or actually destroys the adhesive bonding of the overlying window material to the paperboard itself. Any of these failures, or worse still, several of them simultaneously ruins the appearance and the acceptability of the windowed carton.

Accordingly, many efforts have been made in composite folding cartons, (those in which window panels are adhered to underlying paperboard blanks in areas which extend over two or more contiguous panels) to eliminate the deleterious aesthetic effects of crinkling, tearing, separation or combinations thereof in the window area. These efforts have concentrated on eliminating or reducing the stressing of the composite blank in the sensitive areas, the zones of the window periphery where the plastic sheet is adhered to the paperboard blank along fold lines between contiguous panels. The present invention provides a solution to this problem which permits the production of folding cartons having a comparatively heavy plastic sheet material closing off display windows formed by apertures extending over two or three contiguous main carton panels in a manner which avoids stress wrinkling of the adhered plastic sheet material, which avoids cracking and/or bursting of the paperboard blank at the score lines where the contiguous panel members are adhered to the plastic sheet, and which avoids delamination, separation or destruction of the sealing adhesive which secures the carton blank to the overlying plastic to the paperboard blank.

SUMMARY OF THE PRESENT INVENTION

In accordance with the principles of the invention, the avoidance of the aforementioned problems may be achieved by providing a window aperture cutout design which eliminates the compression and tension stresses which heretofore have been induced at the fold lines adjacent the region of adherence of the film to the paperboard at the window areas. Specifically, this is accomplished by forming specific stress relieving slots in the zones of superimposition of the window material with the line of articulation between contiguous panels so as to avoid any adhesion whatever of plastic window sheet material to paperboard along the line of articulation between contiguous panels. Thus the line of weakness or fold line between contiguous panels forming the corner of the carton about which the window panel extends is formed by score lines between the adjacent panels which terminate short of the window opening. The effective line of articulation is extended from the end of the score line and into the window aperture by means of an elongated slot which is colinear with the score line and which extends from the end of the score line into the general window aperture portion itself. Thus there is no bonding whatever of film to paperboard along the line of articulation between contiguous carton panels in the area of the display window.

The aforementioned stress relieving slots provide a non-adhered "line of weakness" which is other than a score line. An alternative means of obtaining non-adherence of the plastic sheet to the paperboard along the corner portions of the carton at the junctures of sheet to paperboard may be effected by terminating the score lines defining the lines of articulation between contiguous panels at points short of the edge of the plastic and forming a cut line from that point line into the window opening. The cut line is essentially colinear with the score line and defines the line of articulation between contiguous panels. In addition, a short perpendicular cut line may be included at the point where the cut line meets the hinge line or score line between contiguous panels.

It has been determined that the efficacy of the aforementioned stress relieving slot disposed under the plastic sheet is enhanced when the slot is slightly longer than it is wide and it is provided with a radius at its closed end. It will be appreciated, of course, that this particular preferred slot design (or the alternative of a cut line disposed beneath the sheet in an adhesive-free zone) eliminates the lap joint between plastic and paperboard in the area of folding between contiguous major panels.

For a more complete understanding of the principles of the present invention and a greater appreciation of the attendant advantages to be derived from its practice, reference should be made to the following detailed description taken in conjunction with the accompanying drawings.

DETAILED DESCRIPTION OF THE INVENTION

Figure 1:
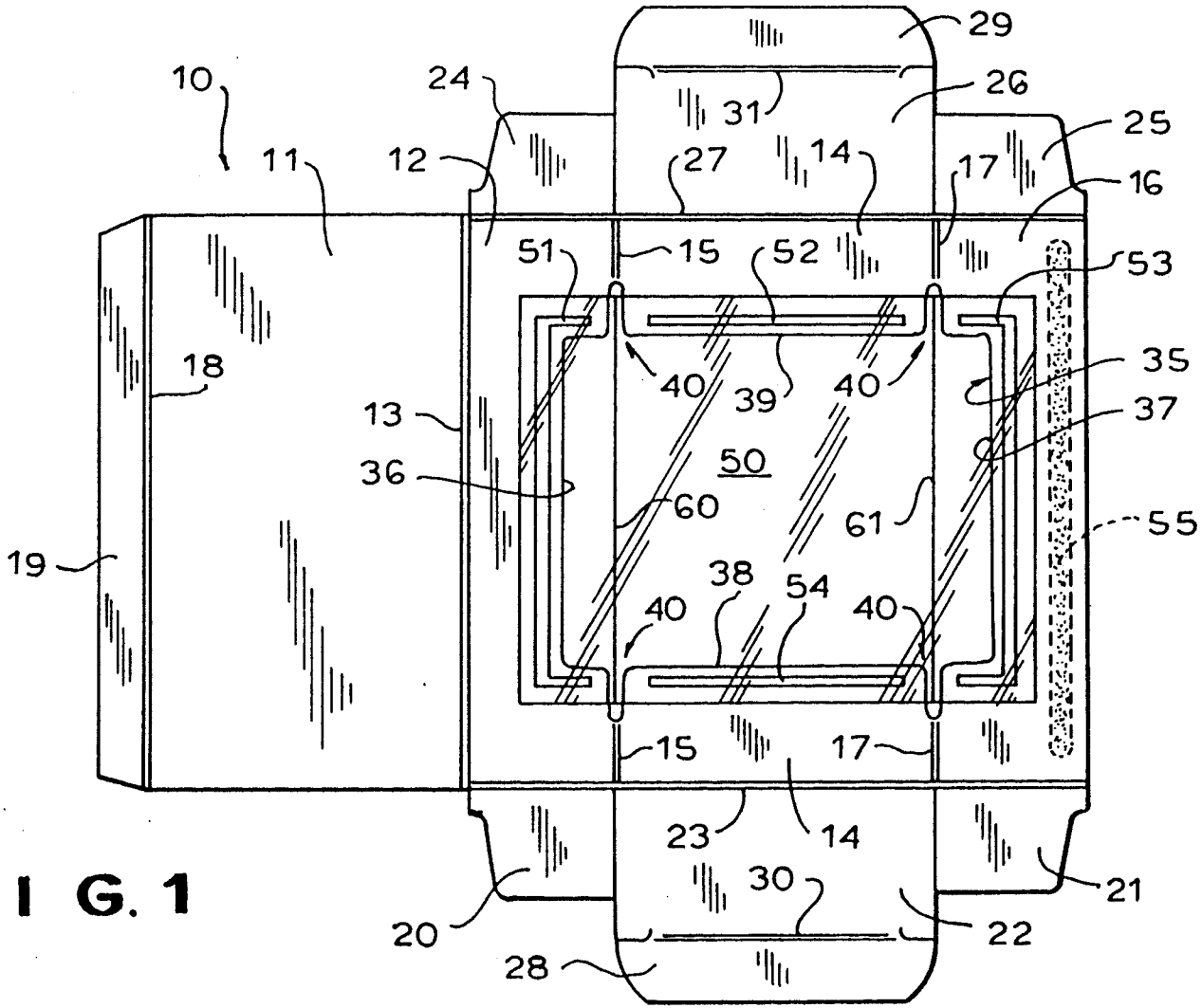
FIG. 1 is a plan view of a flat composite blank formed of a cut and scored paperboard sheet having a window portion extending across three contiguous major panels which window portion is closed by a superimposed clear plastic sheet adhered to said blank in all but the portions of overlap of the window sheet with the lines of articulation of the contiguous panels in which portions stress relieving slots are formed.

Referring now to FIG. 1, the new and improved composite blank of the present invention comprises paperboard element which has been cut and scored as shown to form a rear panel 11 articulated to a first side panel 12 along a horizontal score line 13. The side panel 12 is articulated to a front panel 14 along a score line 15. The front panel 14 is also articulated to a second side panel 16 along a score line 17. The score lines 13, 15 and 17 are parallel with a score line 18 to which is articulated a manufacturer's flap 19. Bottom side flaps 20, 21 and bottom end flap 22 are articulated to the lower edges of the side panels 12 and 16 and the front panel 14 by a continuous score line 23. Similarly top end flaps 24 and 25 and top end flap 26 are articulated to the top edges of the side panels 12 and 16 and front panel 14 along a score line 27 which is parallel to the score line 23.

Figure 3:
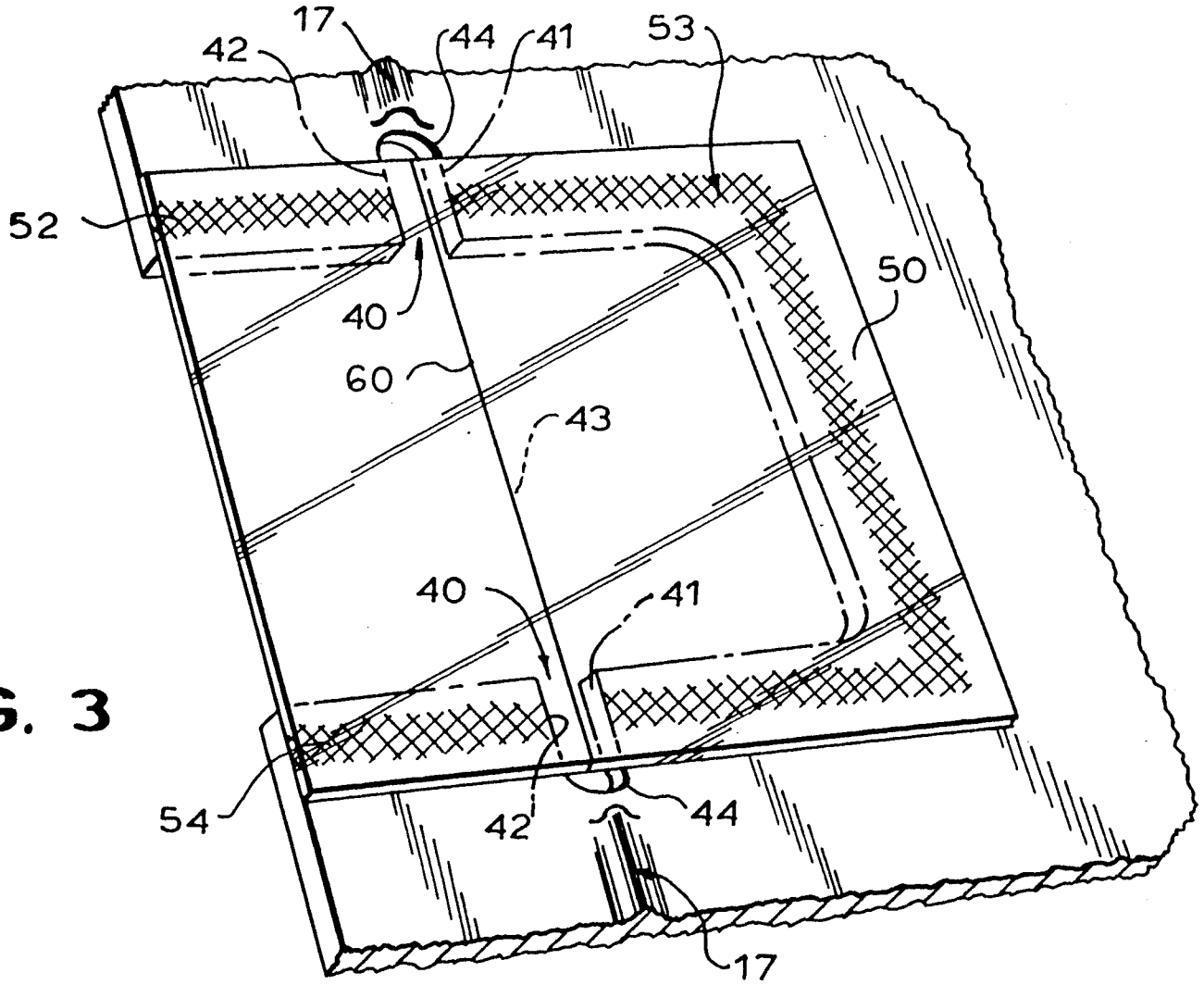
FIG. 3 is an enlarged perspective view showing in detail the construction of the composite carton blank in the window area of the line of articulation between consecutive major panels.

Closing flaps 28, 29 are articulated to the bottom and top flaps 22, 26 along parallel score lines 30, 31 as shown. In accordance with the principles of the invention, a large display window aperture 35 is formed in the blank and the aperture 35 extends across the front panel 14 into the adjacent side panels 12 and 16. The window 35 is formed by a shallow U-shaped cut 36 formed in the panel 12, a similar cut 37 formed in the panel 16, and two parallel cuts 38, 39 extending substantially across the front panel 14. In accordance with the principles of the invention, each of the cuts 36, 37 38 and 39 terminates short of the lines of articulation between the front panels and the side panels which are generally defined by the spaced score lines 17 and the spaced score lines 15. Specifically, the cuts 36, 37, 38 39 are connected in the area of the lines of articulation between contiguous panels by elongated slots 40. As shown in FIG. 3, the slots 40 are generally co-linear with the score lines 15, 17 forming the line of articulation between major panels 12, 14 and 16. More specifically, the slots 40 have parallel side portions 41, 42 which straddle the line of articulation 43 defined in part by the score lines 15 and 17. The line of articulation will define the established corners of the carton about which the windows 35 extends between contiguous major panels. The end of the slot 40 terminates adjacent to the ends of the score lines 15 and has a radius 44 as shown. Advantageously the length of the slot 40 is slightly greater than its width.

In accordance with the principles of the invention, the plastic window sheet 50 is adhered to the underlying carton blank 10 by a series of adhesive bands 51, 52, 53 and 54 as shown in FIGS. 1 and 3. Adhesive bands 51, 52, 53 and 54 are discontinuous in that they do not extend over the lines of articulation 43 in the area of the superimposition of the plastic material 50 with the underlying paperboard blank 10. Thus there is no bonding of plastic and paperboard and/or adhesive in the specific zone of the lap joint connecting the plastic to the paperboard at the line of articulation between contiguous major panels where those major panels are intersected by the window aperture 35 and closed off by a superimposed plastic sheet 50. The window sheet 50 has parallel score lines 60, 61 formed therein and extending completely thereacross which score lines are colinear with score lines 15, 17 and form protions of the carton corners when the blank 10 is subsequently folded and erected.

Figure 2:
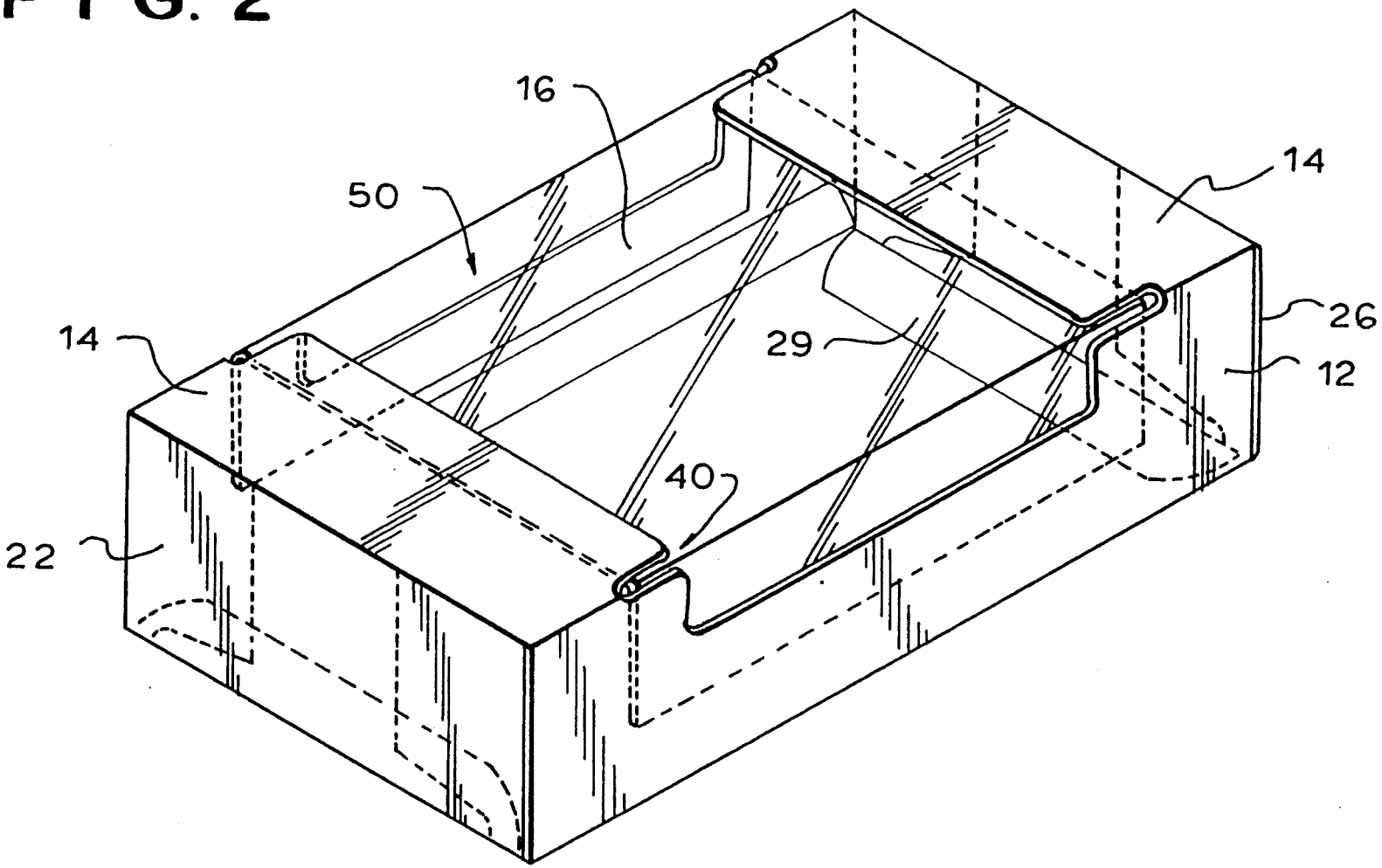
FIG. 2 is a perspective view of a new and improved windowed carton erected from the blank FIG. 1;3

As will be understood, the composite carton blank shown in FIG. 1 may be formed into a conventional flat-folded tube by folding the rear panel 11 over the side panel 12 and front panel 14 and thereafter adhering the manufacturer's flap 19 to the side panel 16 by a suitable adhesive strip 55. The resulting flat folded carton tube may be squared and erected utilizing conventional carton equipment. The carton walls and flaps are erected into a parallelpiped shape shown in FIG. 2. In accordance with the principles of the invention, the window 35 covered by the plastic sheet 50 extends clearly across the front wall 14 of the carton and into the contiguous side walls 12 and 16 in a manner in which the corners between the contiguous walls defined by lines of articulation 43 and score lines 60, 61 are sharp, square, and in nowise crinkled, delaminated, torn or otherwise unsightly as is often the case in cartons having windows extending around corners.

While the present invention has been described with reference to a particular preferred embodiment by way of illustration and example only, it will be appreciated by those skilled in the art that variations in the specific described structure may be made without departing from the specific teachings of the invention. Carton blanks may be made in which the display window extends only between two contiguous major panels rather than across three panels as shown. Variations may be made in the size and geometry of the stress relieving means provided in the zones where the lines of articulation coincide with the overlying plastic sheet and the paperboard blank. Accordingly, reference should be made to the following appended claims to determine the full scope of the present invention.

I claim:

1. A composite blank for a folding carton, said blank comprising:

(a) a sheet a paperboard cut and scored along a series of lines of articulation to define consecutively articulated major panel;

(b) said major panels including a front panel, a first side panel, a rear panel, and a second side panel having upper and lower edges;

(c) said panels having top and bottom panels and side flaps articulated to said upper and lower edges;

(d) a manufacturer's flap articulated to one of said major panels;

(e) a window aperture defined in at least two contiguous major panels by a discrete series of cut portions terminating short of the line of articulation between said at least two contiguous panels;

(f) said discrete cut portions being interconnected by elongated slots disposed colinearly with said line or lines of articulation;

(g) a sheet of transparent plastic window material superimposed upon said paperboard in juxtaposition with said aperture;

(h) said plastic sheet having a score line or score lines collinear with said line or lines of articulation.

(i) an adhesive layer joining said plastic sheet and said paperboard in predetermined areas about the periphery of said aperture;

(j) zones of said blank and said plastic disposed immediately adjacent to said elongated slots being free of adhesive, whereby said major panels may be erected into parallelpiped form with the superimposed plastic window sheet without any wrinkling or delamination of said plastic sheet from said paperboard.

2. The composite blank of claim 1 in which (a) said window aperture extends into three contiguous panels.

3. The composite blank of claim 1 in which (a) each of said elongated slots is slightly longer than it is wide;

(b) each of said elongated slots terminates in a radius portion.

4. The composite blank of claim 1 in which (a) said elongated slots extend beyond the edges of said superimposed plastic sheet material.

* * * * *